US007300242B2

(12) United States Patent
Liang

(10) Patent No.: US 7,300,242 B2
(45) Date of Patent: Nov. 27, 2007

(54) TURBINE AIRFOIL WITH INTEGRAL COOLING SYSTEM

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 91 days.

(21) Appl. No.: 11/293,463

(22) Filed: Dec. 2, 2005

(65) Prior Publication Data

US 2007/0128030 A1 Jun. 7, 2007

(51) Int. Cl.
*F01D 25/12* (2006.01)

(52) U.S. Cl. ..... 415/115

(58) Field of Classification Search ..... 415/191, 415/115; 416/97 R

See application file for complete search history.

(56) References Cited

U.S. PATENT DOCUMENTS

| | | | | |
|---|---|---|---|---|
| 4,021,135 | A | 5/1977 | Pedersen et al. | |
| 4,076,454 | A | 2/1978 | Wennerstrom | |
| 4,345,875 | A | 8/1982 | Charpentier | |
| 4,515,526 | A | 5/1985 | Levengood | |
| 5,165,852 | A | 11/1992 | Lee et al. | |
| 5,405,242 | A * | 4/1995 | Auxier et al. | 415/115 |
| 5,423,608 | A | 6/1995 | Chyou et al. | |
| 5,536,143 | A | 7/1996 | Jacala et al. | |
| 5,538,394 | A | 7/1996 | Inomata et al. | |
| 5,797,726 | A | 8/1998 | Lee | |
| 6,153,889 | A * | 11/2000 | Jones | 250/559.45 |
| 6,206,638 | B1 | 3/2001 | Glynn et al. | |
| 6,402,470 | B1 * | 6/2002 | Kvasnak et al. | 416/97 R |
| 6,554,571 | B1 | 4/2003 | Lee et al. | |
| 6,755,612 | B2 | 6/2004 | Shahpar et al. | |
| 6,887,042 | B2 | 5/2005 | Ito et al. | |
| 6,890,154 | B2 | 5/2005 | Cunha | |
| 2004/0265128 | A1 | 12/2004 | Scott et al. | |

* cited by examiner

*Primary Examiner*—Ninh H. Nguyen

(57) ABSTRACT

A turbine airfoil usable in a turbine engine and having at least one cooling system. At least a portion of the cooling system may be positioned in an outer wall of the turbine airfoil and be formed from a multi-chambered, metering orifice. The multi-chambered, metering orifice may include a first diffusor coupled to a fluid supply channel through a first metering orifice. The first diffusor may be configured to form a vortex of cooling fluids. The multi-chambered, metering orifice may include a second diffusor in communication with an outer surface of the airfoil to exhaust cooling fluids from the airfoil. The second diffusor may be in fluid communication with the first diffusor through a second metering orifice. The second diffusor may be configured to reduce the velocity of the cooling fluids and to enable formation of a film cooling layer on the outer surface of the turbine airfoil.

19 Claims, 4 Drawing Sheets

TURBINE AIRFOIL WITH INTEGRAL COOLING SYSTEM

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane. While advances have been made in the cooling systems in turbine vanes, a need still exists for a turbine vane having increased cooling efficiency for dissipating heat and passing a sufficient amount of cooling air through the vane.

SUMMARY OF THE INVENTION

This invention relates to a turbine vane having an internal cooling system for removing heat from the turbine airfoil. The turbine airfoil may be formed from a generally elongated hollow airfoil having a leading edge, a trailing edge, a pressure side, a suction side, a first end adapted to be coupled to a hook attachment, a second end opposite the first end and adapted to be coupled to an inner endwall, and a cooling system in the outer wall. The cooling system may be formed from at least one fluid supply channel and at least one multi-chambered, metering orifice. The multi-chambered, metering orifice may include devices for metering the flow of cooling fluids through the cooling system and may enable the velocity of cooling fluids to be regulated so that the cooling fluids may be exhausted through openings in the outer surface without disrupting the film cooling layer.

The at least one multi-chambered, metering orifice may be formed from a first diffusor formed from at least one cavity positioned in the outer wall of the generally elongated hollow airfoil, a first metering orifice extending from the at least one fluid supply channel to the first diffusor, a second diffusor formed from at least one cavity in an outer surface of the outer wall of the generally elongated hollow airfoil, and a second metering orifice positioned in the outer wall of the airfoil and creating a fluid pathway between the first diffusor and the second diffusor. The first metering orifice may be coupled to the first diffusor such that a sidewall of the first metering orifice is generally aligned with a sidewall of the first diffusor. The first metering orifice may be coupled to the first diffusor such that a sidewall of the first metering orifice is generally aligned with a wall of the first diffusor defining a side of the first diffusor closest to an outer surface of the outer wall. Such a configuration cause cooling fluids to form a vortex in the first diffusor and increase the rate of convection.

The multi-chambered, metering orifice may also include a second diffusor forming an opening in an outer surface of the airfoil. The second diffusor receives cooling fluids from the second metering orifice. In at least one embodiment, the second metering orifice extends from a side surface of the first diffusor that is positioned farthest from the outer surface of the outer wall of the airfoil. The second diffusor may extend at an acute angle relative to a center line of the outer wall and extend from the first diffusor to an outer surface of the outer wall to expel cooling fluid from the airfoil generally in a downstream direction. The second diffusor may be formed from any shape for reducing the velocity of the cooling fluids being released through the outer surface of the airfoil. In at least one embodiment, the second diffusor may have a generally bell-shaped opening extending from the second metering orifice to the outer wall of the airfoil.

The cooling system may be formed from a plurality of multi-chambered, metering orifices in the outer wall forming chordwise rows. The plurality of multi-chambered, metering orifices in the outer wall may be aligned in a spanwise direction to form spanwise rows in the airfoil. In other embodiments, the multi-chambered, metering orifices may be offset in the spanwise direction in the airfoil relative to the adjacent chordwise multi-chambered, metering orifices.

During operation, the cooling fluids flow through the internal cooling cavity of the turbine airfoil. At least a portion of the cooling fluids flow into the fluid supply channels where the cooling fluids remove heat from the walls forming the outer wall. The first metering orifices meter the flow of cooling fluids into the multi-chambered, metering orifices. The cooling fluids flow through the first metering orifices and into the first diffusors. The cooling fluids are directed into the first diffusors at such an angle that the cooling fluids form vortices in the first diffusors. The vortices increase the convection rate in the first diffusors, which reduce the temperature of the outer wall. The cooling fluids are exhausted from the first diffusors through the second metering orifices, which meter the flow of cooling fluids. The cooling fluids flow through the second metering orifices and are exhausted into the second diffusors. The velocity of the cooling fluids is reduced in the second diffusors as the cooling fluids expand in an ever expanding cross-section of the second diffusors, which may be bell-shaped. The reduced velocity of the cooling fluids limits the formation of turbulence in the boundary layer of film cooling fluids proximate to the outer surface of the airfoil. Thus, a boundary layer of cooling fluids may be formed with the cooling fluids exhausted from the multi-chambered, metering orifices to reduce the temperature of the outer surface of the airfoil.

An advantage of this invention is the cavities in the outer wall of the hollow airfoil may be sized and shaped appropriately to account for localized pressures and heat loads to more effectively use available cooling fluids.

Another advantage of this invention is that the cooling system includes two layers of metering systems, first and second metering orifices, which meter flow into the cavities in the outer wall, and meter flow to outer surfaces of the airfoil, respectively. These features enable cooling fluids to be discharged from the airfoil and form a coolant sub-boundary layer proximate to an outer surface of the airfoil.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
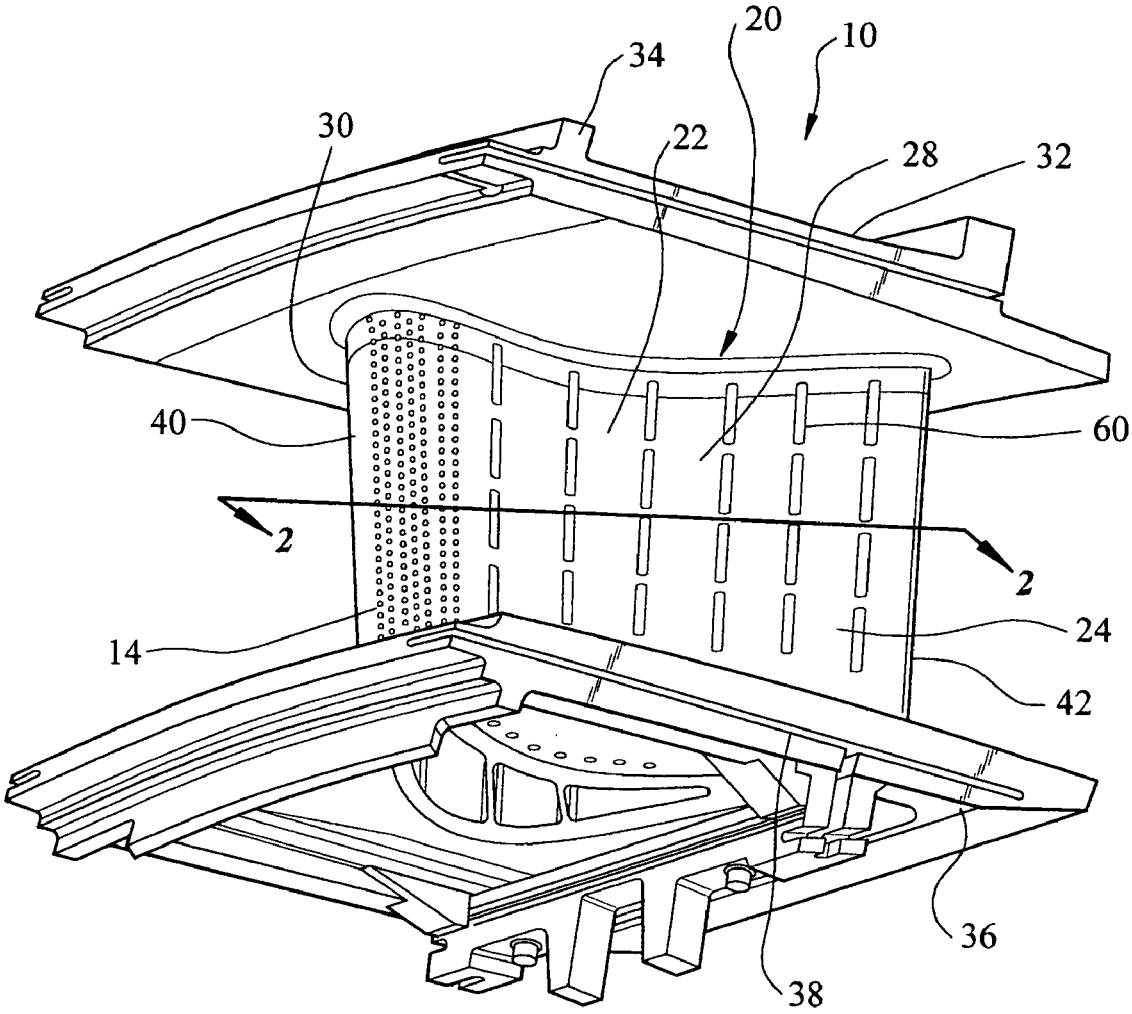
FIG. 1 is a perspective view of a turbine airfoil having features according to the instant invention.

As shown in FIGS. 1-5, this invention is directed to a turbine vane 10 having a cooling system 12 in inner aspects of the turbine vane 10 for use in turbine engines. The cooling system 12 may be used in any turbine vane or turbine blade. While the description below focuses on a cooling system 12 in a turbine vane 10, the cooling system 12 may also be adapted to be used in a turbine blade. The cooling system 12 may be configured such that adequate cooling occurs within an outer wall 14 of the turbine vane 10 by including one or more cavities 16 in the outer wall 14 and configuring each cavity 16 based on local external heat loads and airfoil gas side pressure distribution in both chordwise and spanwise directions. The chordwise direction is defined as extending between a leading edge 40 and a trailing edge 42 of the airfoil 10, and the spanwise direction is defined as extending between an inner endwall 38 and an endwall 32. In particular, the cooling system 12 may include one or more fluid supply channels 18 and multi-chambered, metering orifices 20 that act as metering orifices and diffusors in the cooling system 12 to reduce the velocity of cooling fluids passing from the turbine vane 10. The cooling fluids may mix with the film cooling fluids once exhausted from the multi-chambered, metering orifices 20.

As shown in FIG. 1, the turbine vane 10 may be formed from a generally elongated airfoil 22 having an outer surface 24 adapted for use, for example, in an axial flow turbine engine. Outer surface 24 may have a generally concave shaped portion forming pressure side 28 and a generally convex shaped portion forming suction side 30. The turbine vane 10 may also include an outer endwall 32 adapted to be coupled to a hook attachment 34 and may include a second end 36 adapted to be coupled to an inner endwall 38. The airfoil 22 may also include a leading edge 40 and a trailing edge 42.

Figure 2:
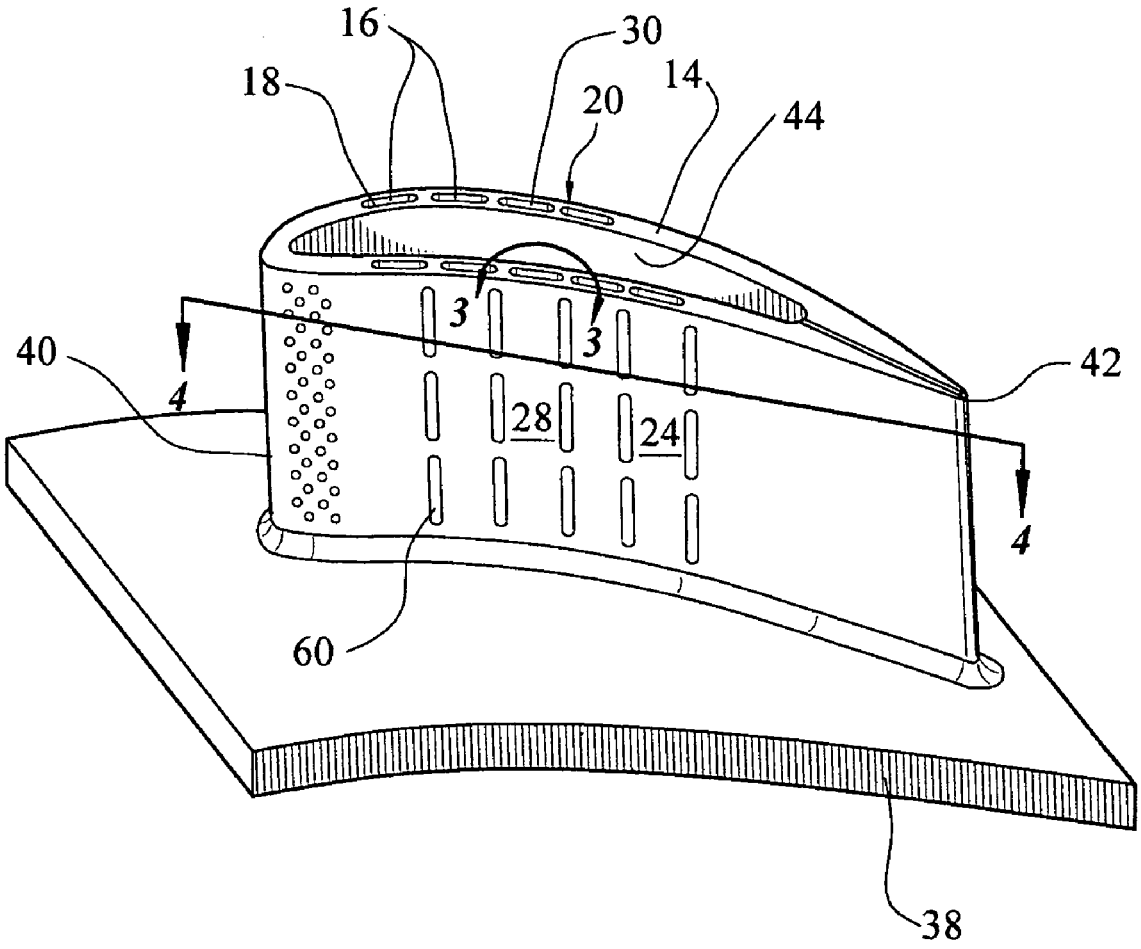
FIG. 2 is a cross-sectional view of the turbine airfoil shown in FIG. 1 taken along line 2-2.
Figure 3:
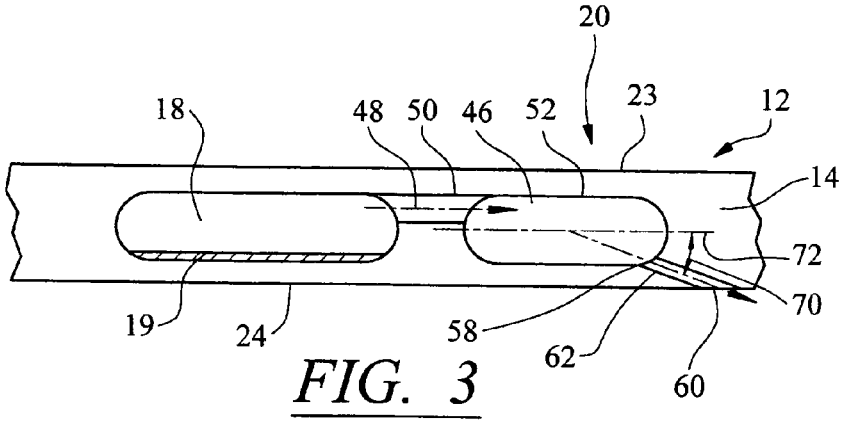
FIG. 3 is a partial cross-sectional view of a cooling system in the turbine airfoil shown in FIG. 2 taken at detail 3.

As shown in FIGS. 2 and 3, the cooling system 12 may be formed from at least one internal cooling cavity 44, which may have any number of configurations sufficient to remove a desired amount of heat from the turbine vane 10. The cooling system 12 may also include one or more fluid supply channels 18 in the outer wall 14. The fluid supply channel 18 supplies cooling fluids to the multi-chambered, metering orifices 20. The fluid supply channels 18 may include trip strips 19 or other convection rate increasing devices.

Figure 4:
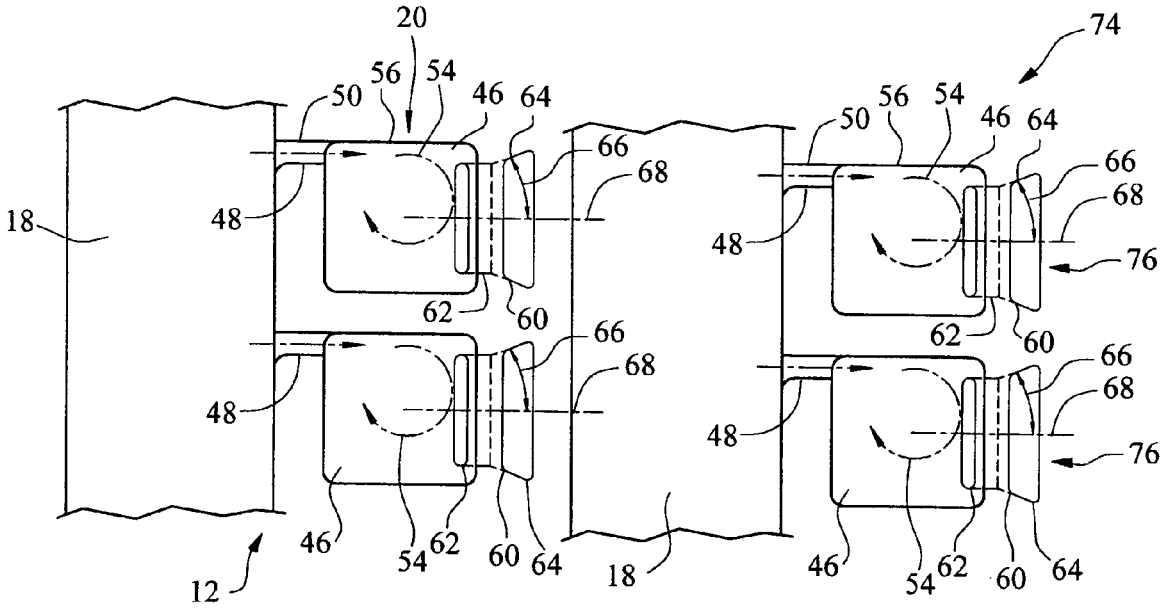
FIG. 4 is a partial cross-sectional view of the turbine airfoil taken at section line 4-4 in FIG. 2.

The multi-chambered, metering orifice 20 may be formed from a first diffusor 46 positioned in the outer wall 14 of the turbine vane 10. The first diffusor 46 may be in fluid communication with the fluid supply channel 18 through a first metering orifice 48. The first metering orifice 48 may be sized based upon the local heat loads, pressure, and other applicable factors. The first metering orifice 48 may be positioned to create a vortex of cooling fluids in the first diffusor 46. The first metering orifice 48 may be positioned such that cooling fluids exhausted from the first metering orifice 48 flow generally parallel to the sidewall 52 of the first diffusor 46. In other words, as shown in FIGS. 3 and 4, the first metering orifice 48 may be positioned such that a sidewall 50 of the first metering orifice 48 is flush with, or generally aligned with, the sidewall 56 of the first diffusor 46. In this position, cooling fluids entering the first diffusor 46 create a vortex shown by an arrow 54. The first metering orifice 48 may also be positioned such that the sidewall 50 of the first metering orifice 48 is generally aligned with an inner wall 52 closest to the inner surface 23 of the airfoil 22. Cooling fluids exhausted from the first metering orifice 48 may be exhausted generally parallel to the sidewall 52 of the first diffusor 46. In at least one embodiment, as shown in FIG. 3, the second metering orifice 62 may be coupled to the first diffusor 46 at an outer corner 58 of the first diffusor 46.

The multi-chambered, metering orifice 20 may also include a second diffusor 60 that provides an opening in the outer surface 24 of the airfoil 22. The second diffusor 60 may be in fluid communication with the first diffusor 46 through the second metering orifice 62. The second metering orifice 62 may be sized and configured based upon local heat loads, pressures, and other applicable factors. The second metering orifice 62 may be sized to limit the flow of cooling fluids from the first diffusor 46. The second metering orifice 62 may have any size and shape capable of performing this function. In one embodiment, as shown in FIG. 4, the second metering orifice 62 may be configured as an elongated slot having rounded sidewalls.

The second diffusor 60 may be sized to prevent disruption of the film cooling layer proximate to the outer surface 24 of the airfoil 22. As shown in FIG. 4, the second diffusor 60 may have a general bell-shape for reducing the velocity of the cooling fluids as the cooling fluids are exhausted from the diffusor 60. In at least one embodiment, as shown in FIG. 4, the upper and lower walls 64 of the second diffusor 60 may be positioned at an angle 66 of between about five degrees and about fifteen degrees relative to a centerline 68 of the second diffusor 60, and in one embodiment, the sidewalls 64 of the diffusor 60 may be positioned at an angle 66 of between about ten degrees relative to the centerline 68 of the second diffusor 60. The second diffusor 60 may also extend at an acute angle 70, as shown in FIG. 3, relative to a centerline 72 of the second diffusor 60. In at least one embodiment, the acute angle 70 may be between about twenty degrees and about sixty degrees. Such a configuration enables cooling fluids to be exhausted from the multi-chambered, metering orifice 20 without disruption of the film cooling layer proximate to the outer surface 24 of the airfoil 22.

Figure 5:
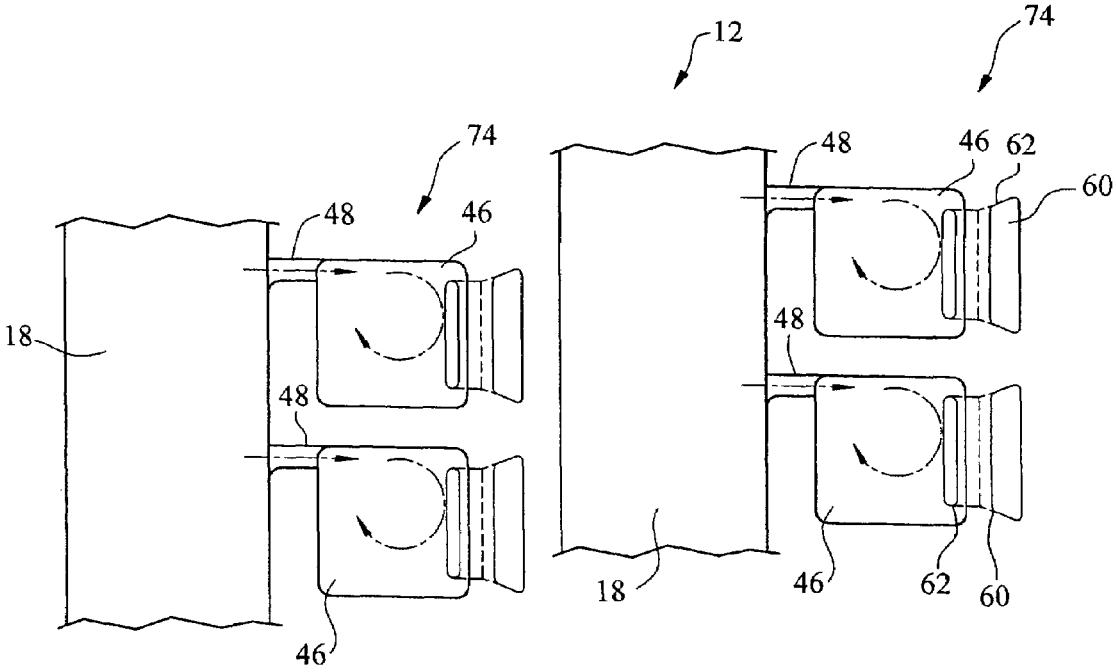
FIG. 5 is partial cross-sectional view of an alternative embodiment of the invention shown in FIG. 2.

As shown in FIGS. 1 and 4, the multi-chambered, metering orifices 20 may be positioned in chordwise rows 74. The multi-chambered, metering orifices 20 may be aligned in the spanwise direction to form spanwise rows 76. In another embodiment, as shown in FIG. 5, the multi-chambered, metering orifices 20 may be offset in the spanwise direction relative to multi-chambered, metering orifices 20 in an adjacent row 74.

During operation, the cooling fluids flow through the internal cooling cavity 44 of the turbine vane 10. At least a portion of the cooling fluids flow into the fluid supply channels 18 where the cooling fluids remove heat from the walls forming the outer wall 14. The first metering orifices 48 meter the flow of cooling fluids into the multi-chambered, metering orifices 20. The cooling fluids flow through the first metering orifices 48 and into the first diffusors 46. The cooling fluids are directed into the first diffusors 46 at such an angle that the cooling fluids form vortices 54 in the first diffusors 46. The vortices increase the convection rate in the first diffusors 46, which reduce the temperature of the outer wall 14. The cooling fluids are exhausted from the first diffusors 46 through the second metering orifices 62. The second metering orifices 62 meter the flow of cooling fluids with the size of the orifices 62. The cooling fluids flow through the second metering orifices 62 and are exhausted into second diffusors 60. The velocity of the cooling fluids is reduced in the second diffusors 60 as the cooling fluids expand in an ever expanding cross-section of the second diffusors 60, which may be bell-shaped. The reduced velocity of the cooling fluids limits the formation of turbulence in the boundary layer of film cooling fluids proximate to the outer surface 24. Thus, a boundary layer of cooling fluids may be formed with the cooling fluids exhausted from the multi-chambered, metering orifices 20 to reduce the temperature of the outer surface 24 of the airfoil 22.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, a suction side, a first end adapted to be coupled to a hook attachment, a second end opposite the first end adapted to be coupled to an inner endwall; and a cooling system in the outer wall of the hollow airfoil, comprising:

at least one fluid supply channel; and at least one multi-chambered, metering orifice, comprising:

a first diffusor formed from at least one cavity positioned in the outer wall of the generally elongated hollow airfoil;

a first metering orifice extending from the at least one fluid supply channel to the first diffusor;

a second diffusor formed from at least one cavity in an outer surface of the outer wall of the generally elongated hollow airfoil; and a second metering orifice positioned in the outer wall of the airfoil and creating a fluid pathway between the first diffusor and the second diffusor.

2. The turbine airfoil of claim 1, wherein the first metering orifice is coupled to the first diffusor such that cooling fluids discharged from the first metering orifice create vortex in the first diffusor.

3. The turbine airfoil of claim 2, wherein the first metering orifice is coupled to the first diffusor such that cooling fluids discharged from the first metering orifice flow generally parallel to a sidewall of the first diffusor.

4. The turbine airfoil of claim 3, wherein the first metering orifice is coupled to the first diffusor such that cooling fluids discharged from the first metering orifice flow generally parallel to a wall of the first diffusor positioned closest to the outer surface of the outer wall of the airfoil.

5. The turbine airfoil of claim 1, wherein the first metering orifice is coupled to the first diffusor such that a sidewall of the first metering orifice is generally aligned with a sidewall of the first diffusor.

6. The turbine airfoil of claim 5, wherein the first metering orifice is coupled to the first diffusor such that a sidewall of the first metering orifice is generally aligned with a wall of the first diffusor defining a side of the first diffusor closest to the outer surface of the outer wall.

7. The turbine airfoil of claim 1, wherein the first metering orifice is coupled to the first diffusor such that a sidewall of the first metering orifice is generally aligned with a wall of the first diffusor defining a side of the first diffusor closest to the outer surface of the outer wall.

8. The turbine airfoil of claim 1, wherein the second diffusor extends at an acute angle relative to a center line of the outer wall and extends from the first diffusor to the outer surface of the outer wall to expel cooling fluid from the airfoil generally in a downstream direction.

9. The turbine airfoil of claim 1, wherein the cooling system comprises a plurality of multi-chambered, metering orifices in the outer wall forming chordwise rows.

10. The turbine airfoil of claim 9, wherein the plurality of multi-chambered, metering orifices in the outer wall are aligned in a spanwise direction to form spanwise rows in the airfoil.

11. The turbine airfoil of claim 10, wherein the multi-chambered, metering orifices are offset in the spanwise direction in the airfoil relative to an adjacent chordwise multi-chambered, metering orifices.

12. The turbine airfoil of claim 1, wherein the second diffusor comprises a generally bell-shaped opening extending from the second metering orifice to the outer wall of the airfoil.

13. The turbine airfoil of claim 1, wherein the second metering orifice extends from a side surface of the first diffusor that is positioned farthest from the outer surface of the outer wall of the airfoil.

14. A turbine airfoil, comprising:

a generally elongated hollow airfoil formed from an outer wall, and having a leading edge, a trailing edge, a pressure side, a suction side, a first end adapted to be coupled to a hook attachment, a second end opposite the first end adapted to be coupled to an inner endwall, and a cooling system in the outer wall of the hollow airfoil, comprising:

at least one fluid supply channel; and at least one multi-chambered, metering orifice, comprising:

a first diffusor formed from at least one cavity positioned in the outer wall of the generally elongated hollow airfoil;

a first metering orifice extending from the at least one fluid supply channel to the first diffusor;

a second diffusor formed from at least one exterior metering orifice in an outer surface of the outer wall of the generally elongated hollow airfoil; and a second metering orifice positioned in the outer wall of the airfoil and creating a fluid pathway between the first diffusor and the second diffusor;

wherein the first orifice is coupled to the first diffusor such that a sidewall of the first metering orifice is generally aligned with a sidewall of the first diffusor.

15. The turbine airfoil of claim 14, wherein the first metering orifice is coupled to the first diffusor such that a sidewall of the first metering orifice is generally aligned with a wall of the first diffusor defining a side of the first diffusor closest to the outer surface of the outer wall.

16. The turbine airfoil of claim 14, wherein the second diffusor extends at an acute angle relative to a center line of the outer wall and extends from the first diffusor to the outer surface of the outer wall to expel cooling fluid from the airfoil generally in a downstream direction.

17. The turbine airfoil of claim 14, wherein the cooling system comprises a plurality of multi-chambered, metering orifices in the outer wall forming chordwise rows that are aligned in a spanwise direction to form spanwise rows in the airfoil.

18. The turbine airfoil of claim 14, wherein the cooling system comprises a plurality of multi-chambered, metering orifices in the outer wall forming chordwise rows that are offset in the spanwise direction in the airfoil relative to an adjacent chordwise multi-chambered, metering orifices.

19. The turbine airfoil of claim 14, wherein the second metering orifice extends from a side surface of the first diffusor that is positioned farthest from the outer surface of the outer wall of the airfoil and the second diffusor comprises a generally bell-shaped opening extending from the second metering orifice to the outer wall of the airfoil.

* * * * *